United States Patent [19]

Kenyon

[11] Patent Number: 4,591,959

[45] Date of Patent: May 27, 1986

[54] DECORATIVE LIGHTING FIXTURE

[76] Inventor: J. Stephen Kenyon, P.O. Box 717, 8 Leonard Rd., Enfield, Conn. 06082

[21] Appl. No.: 676,315

[22] Filed: Nov. 29, 1984

[51] Int. Cl.[4] ..... F21S 1/00

[52] U.S. Cl. ..... 362/252; 362/806

[58] Field of Search ..... 362/362, 806, 249, 252

[56] References Cited

U.S. PATENT DOCUMENTS

| | | | |
|---|---|---|---|
| 1,820,681 | 8/1931 | Schmalbach | 362/806 X |
| 1,832,408 | 11/1931 | Modes | 362/362 |
| 2,077,973 | 4/1937 | Wilson | 362/806 X |
| 2,714,652 | 8/1955 | Meyer | 362/806 X |
| 3,536,906 | 10/1970 | Bloom | 362/806 X |

*Primary Examiner*—Tony M. Argenbright

*Attorney, Agent, or Firm*—Fishman & Dionne

[57] ABSTRACT

A decorative lighting fixture is presented which is comprised of a string of lights, each light having a bulb and including means thereon for receiving and forming an airtight connection with an inflatable balloon. As a result, the light bulb from each light is disposed within the inflated balloon to produce a distinctive and attractive appearance.

11 Claims, 2 Drawing Figures

DECORATIVE LIGHTING FIXTURE

BACKGROUND OF THE INVENTION

This invention relates generally to a decorative lighting fixture. More particularly, this invention relates to a decorative lighting fixture comprising a string of lights, each light having a bulb and including means thereon for receiving and forming an airtight connection with an inflatable balloon. As a result, the light bulb from each light is disposed within the inflated balloon to produce a distinctive and attractive appearance.

It is well known that there is an ever present need for novel and attractive contemporary lighting fixtures for use in social, business and other gatherings such as parties, weddings, meetings, conventions, restaurants, etc. Such lighting fixtures take on added significance and utility if they function in a decorative fashion as well as providing lighting. It is also known that elastomeric balloons have become increasingly popular for use as decorations in such social and other settings. As a result, there is a need for new and different methods for utilizing balloons in novel and attractive decorative assemblies. Important considerations in design of such balloon-type decorations include low production costs, ease of assembly and installation, and ability to customize and tailor the decoration for the peculiar needs of the particular social gathering.

Accordingly, it is a principal object of the present invention to provide a unique decorative lighting fixture which utilizes a balloon motif so as to provide a decoration which is attractive and adaptable for a variety of social, business and other gatherings.

It is another object of the present invention to provide a balloon-type decorative lighting fixture which not only functions decoratively, but also provides a significant amount of lighting.

It is still another object of the present invention to provide a balloon-type decorative lighting fixture which can be produced at a low cost and is easy to assemble and install.

It is yet another object of the present invention to provide a balloon-type decorative lighting fixture which can be easily customized and tailored to fit the peculiar needs of the particular social gathering.

DESCRIPTION OF THE DRAWINGS

These and other objects will become more apparent from the following detailed description taken in connection with the accompanying drawings wherein.

DESCRIPTION OF THE PREFERRED EMBODIMENT

Figure 1:
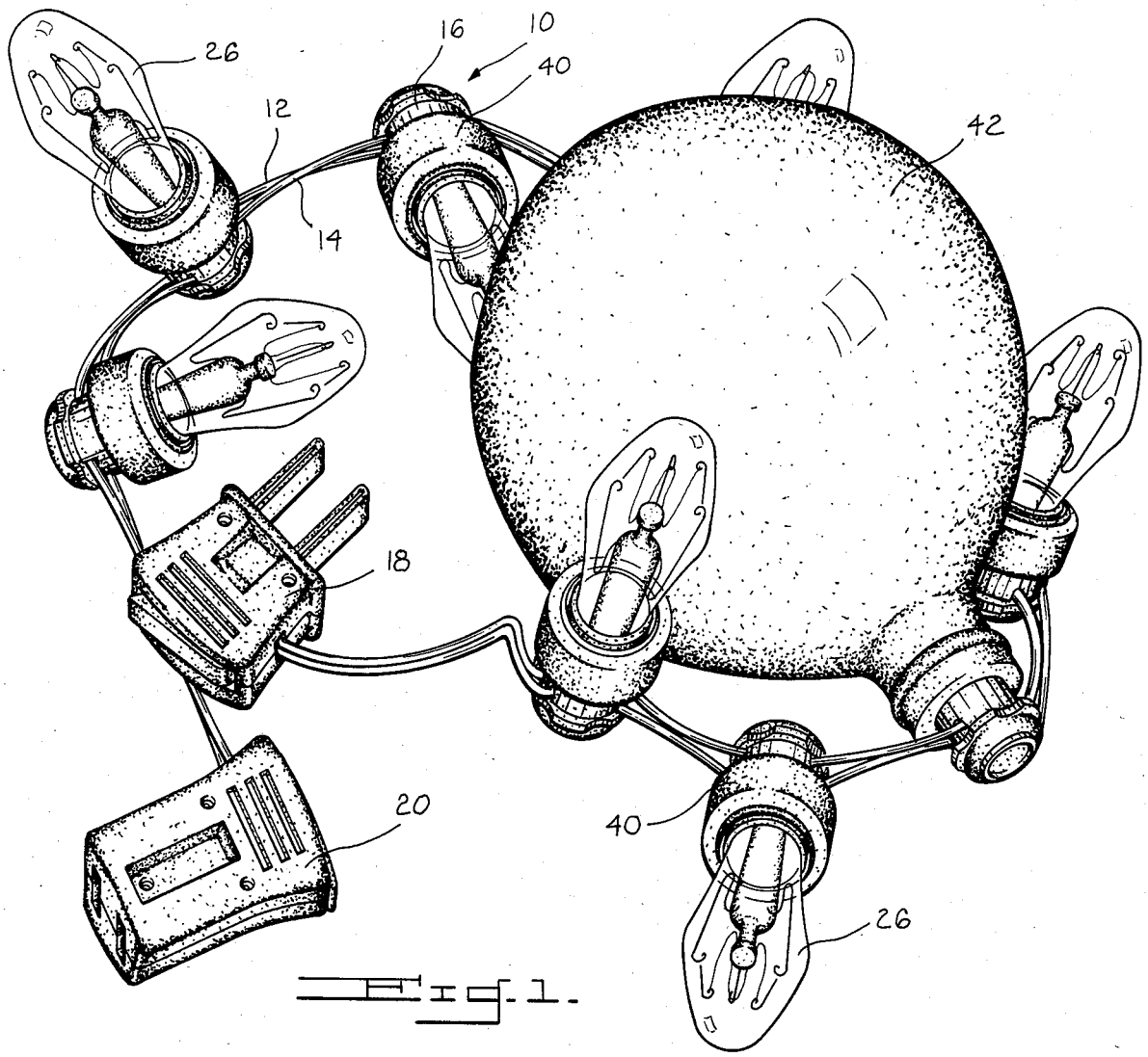
FIG. 1 is a perspective view of the decorative balloon-type lighting fixture of the present invention.

Referring to FIG. 1, a decorative lighting fixture in accordance with the present invention is shown comprising a string of lights 10, i.e., a pair of insulative wire lengths 12 and 14 having a plurality of bulb or lamp sockets 16 mechanically and electrically attached thereto. Light string 10 further includes plug means 18 for connection with an electrical power source and an optional plug receiving means or receptacle 20 for connection with additional light strings (not shown) or other electrical devices. Light string 10 is of a well known construction familiar to those skilled in the art.

Figure 2:
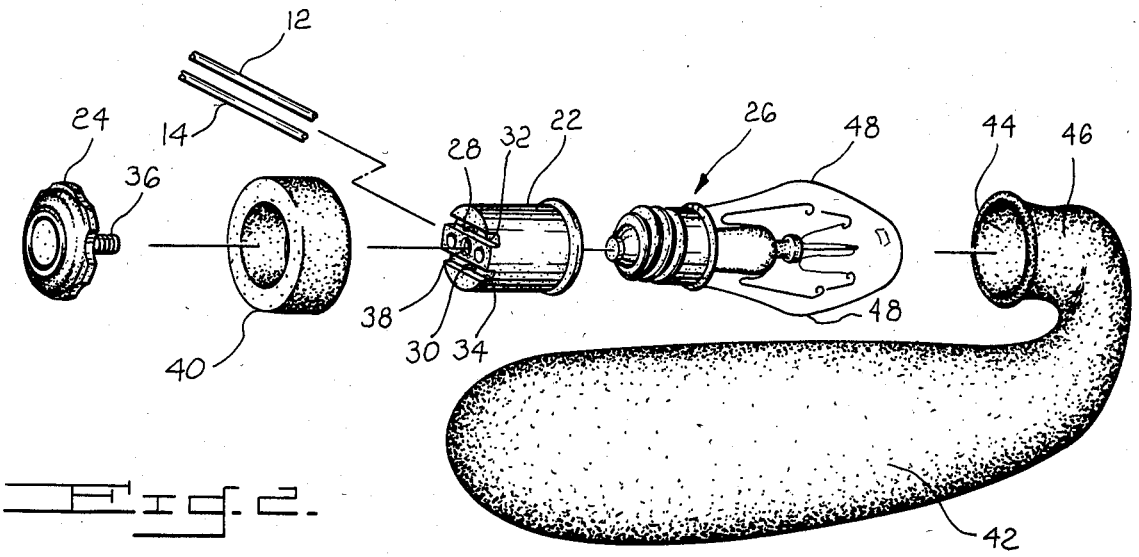
FIG. 2 is an exploded perspective view of a portion of the lighting fixture of FIG. 1.

Referring now to both FIGS. 1 and 2, lamp socket 16 is comprised of a cylindrical body portion 22 and a screw-on base portion 24. Body portion 22 includes at one end a buld or lamp receiving screw socket for threadibly receiving a lamp 26. At the other end of body portion 22 is a pair of pin contacts 28 and 30 respectively disposed along mutually parallel channels 32 and 34. Channels 32, 34 are each sized to receive a wire 12 or 14. After a wire 12 or 14 is placed in each channel 32, 34, the screw 36 of base 24 is threadibly received in threaded opening 38 wherein base 24 forces wires 12, 14 against pin contacts 28, 30 and wherein pin contacts 28, 30 will penetrate the insulation on the wires to effect electrical and mechanical contact therewith. As will be discussed in greater detail hereinafter, adhesive or another appropriate material is provided between base 24 and body portion 22 to effect an airtight seal.

An important feature of the present invention is the use of a novel balloon retaining means preferably consisting of a cylindrical sleeve or band 40 of a resilient material which is disposed about the outside surface of body portion 22 and is held thereon via strong inherent elastic forces. The balloon retaining means should preferably be comprised of a material which will effect a substantially air tight connection between it and an inflatable balloon 42. A preferred material is a resilient polymeric elastomer. Excellent low air loss properties have resulted from a sleeve 40 comprised of a latex rubber or similar elastomer.

During assembly of the novel decorative lighting fixture of the present invention, a light bulb 26 is firmly screwed into each lamp socket 16. Thereafter, the open end 44 of an inflated expandable balloon 42, i.e. latex balloon, is placed over the tip of bulb 26. In the same motion, the collar portion 46 of balloon 42 is rolled onto the widest section 48 of bulb 26. Finally, using the thumb and forefinger of each hand, collar portion 46 of balloon 42 is drawn over sleeve 40 until the collar is positioned between wires 12, 14 and the bottom of sleeve 40. As a result, the neck or collar of the balloon is tightly sealed by the preferably latex sleeve 40 (see FIG. 1). Caution should be taken not to overinflate the balloons during assembly of the instant invention.

As mentioned, it is very important that any air or gas present in the inflated balloon 42 does not escape through an opening in lamp socket 16 after the balloon has been connected to the ballon receiving means. In the well known type of lamp socket 16 disclosed herein, such a gas passage will exist between body portion 22 and base portion 24. (This opening will be present even after screw 36 is tightly screwed into threaded opening 38). Accordingly, an important feature of the present invention is to provide some means of sealing the gas passage between the base 24 and body 22. In a preferred embodiment, this passage is sealed by use of an adhesive material provided therebetween which prevents air or gas from escaping out of balloon 42 and through lamp socket 16.

The present invention provides a decorative light fixture which is very attractive and may be used in a variety of social, business and other gatherings. The use of balloons mounted over lamps and sealed with a balloon retaining means provides a warm glow which not only functions decoratively, but also imparts a significant amount of lighting.

Another important feature of the present invention is the low manufacturing and assembly costs as most of the individual components are readily available and inexpensive.

It will be appreciated that while a single string of lights 10 having seven lamps thereon has been shown in FIG. 1, the decorative light fixture of the present invention includes any number of lamps and balloon sub-assemblies which may be formed in continuous strings or in an infinite number of shapes and sizes. The present invention may thus be easily customized and tailored to fit the peculiar needs of any desired application.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A light fixture sub-assembly comprising:

(a) lamp socket means, said socket means including:

a cylindrical body portion having a first and second end;

means at said first end for receiving a light bulb; and, means at said second end for effecting electrical connection to a power supply, said second end having a gas tight seal;

(b) balloon retaining means disposed on said cylindrical body portion of said lamp socket means, said balloon retaining means comprising a resilient sleeve disposed about the exterior of said cylindrical body portion so as to effect a gas tight seal therebetween; and (c) an inflatable expandable balloon, said balloon having an open end for receiving gas, said open end leading to a collar portion; wherein said balloon is adapted to be placed over a light bulb which has been received in said receiving means; and wherein said collar portion of said balloon and said retaining means effects a substantially gas tight connection without contacting said light bulb.

2. The sub-assembly of claim 1 wherein said balloon retaining means is comprised of an elastomeric material.

3. The sub-assembly of claim 2 wherein said elastomeric material is latex.

4. The sub-assembly of claim 1 wherein said second end of said cylindrical body portion includes:

a detachable base portion; and wherein an airtight seal is provided between said base portion and said body portion via an adhesive.

5. A decorative light fixture comprising:

a string of lights, said light string including a pair of insulated wire lengths, said wire lengths having a plurality of light fixture sub-assemblies electrically and mechanically attached at spaced apart locations thereon;

plug means attached to said string of lights for effecting electrical connection with a power source;

each of said light-fixture sub-assemblies comprising:

(a) lamp socket means, said socket means including:

a cylindrical body portion having a first and a second end;

means at said first end for receiving a light bulb;

means at said second end for effecting electrical connection to said pair of insulating wires, said second end having a gas tight seal;

(b) balloon retaining means, said balloon retaining means being disposed on said cylindrical body portion of said lamp socket means, said balloon retaining means comprising a resilient sleeve disposed about the exterior of said cylindrical body portion so as to effect a gas tight seal therebetween; and (c) an inflatable expandable balloon, said balloon having an open end for receiving gas, said open end leading to collar portion; wherein said balloon is adapted to be placed over a light bulb which has been received in said receiving means; and wherein said collar portion of said balloon and said retaining means effects a substantially gas tight connection without contacting said light bulb.

6. The light fixture of claim 5 wherein said resilient material is an elastomeric sleeve.

7. The light fixture of claim 6 wherein said elastomeric material is latex.

8. The light fixture of claim 5 wherein said second end of said cylindrical body portion includes:

a detachable base portion; and wherein an airtight seal is provided between said base portion and said body portion via an adhesive.

9. A decorative light fixture comprising:

a string of lights, said light string including a pair of insulated wire lengths, said wire lengths having a plurality of light fixture sub-assemblies electrically and mechanically attached at spaced apart locations thereon;

plug means attached to said string of lights for effecting electrical connection with a power source;

each of said light-fixture sub-assemblies comprising:

(a) lamp socket means, said socket means including a cylindrical body portion having a first and second end;

means at said first end for receiving a light bulb; and means at said second end for effecting electrical connection to said pair of insulated wires, said second end having a gas tight seal; and (b) resilient balloon retaining means, said balloon retaining means being in the form of a sleeve comprised of an elastomeric material which is disposed on said cylindrical body portion of said lamp socket means to effect a gas tight seal therebetween;

wherein said balloon retaining means is adapted to effect a substantially air tight connection with the collar portion of a balloon, when the balloon is placed over a light bulb received in said receiving means without contacting said light bulb.

10. The light fixture of claim 9 wherein said elastomeric material is latex.

11. The light fixture of claim 9 wherein said second end of said cylindrical body portion includes:

a detachable base portion; and wherein an airtight seal is provided between said base portion and said body portion via an adhesive.

* * * * *